US008678816B2

(12) United States Patent
Sarrazy

(10) Patent No.: US 8,678,816 B2
(45) Date of Patent: Mar. 25, 2014

(54) HOT AIR INTERNAL IGNITION BURNER/GENERATOR

(75) Inventor: Jean-Claude Sarrazy, Le Haillan (FR)

(73) Assignee: SEFMAT, Le Haillan Cedex (FR)

( * ) Notice: Subject to any disclaimer, the term of this patent is extended or adjusted under 35 U.S.C. 154(b) by 1640 days.

(21) Appl. No.: 12/091,928

(22) PCT Filed: Oct. 28, 2005

(86) PCT No.: PCT/FR2005/002720

§ 371 (c)(1),
(2), (4) Date: Apr. 28, 2008

(87) PCT Pub. No.: WO2007/048886

PCT Pub. Date: May 3, 2007

(65) Prior Publication Data

US 2008/0241781 A1 Oct. 2, 2008

(51) Int. Cl.
*F23D 14/38* (2006.01)
*F23D 14/64* (2006.01)

(52) U.S. Cl.
USPC ..... 432/222; 431/157; 431/158; 431/264; 431/265; 431/266; 431/255; 431/345; 431/142; 431/143; 432/219; 432/47; 126/61; 126/66; 126/67; 126/88; 126/89; 392/383; 392/384; 392/385

(58) Field of Classification Search
USPC ..... 126/25 B, 6, 61, 42, 66, 67, 88, 89, 232, 126/236, 405, 413; 392/383, 384, 385
See application file for complete search history.

(56) References Cited

U.S. PATENT DOCUMENTS

| | | | | | |
|---|---|---|---|---|---|
| 1,959,752 | A | * | 5/1934 | Wintermute | 96/49 |
| 2,332,210 | A | * | 10/1943 | Frank | 431/263 |
| 2,584,888 | A | * | 2/1952 | Latour | 200/82 B |
| 2,629,365 | A | * | 2/1953 | Kennedy | 91/41 |
| 2,645,278 | A | * | 7/1953 | Holthouse, Sr. et al. | 431/263 |
| 2,646,788 | A | * | 7/1953 | Locke | 126/39 H |
| 2,725,929 | A | * | 12/1955 | Massier | 431/158 |
| 2,757,132 | A | * | 7/1956 | Northrop | 205/779.5 |
| 2,885,859 | A | * | 5/1959 | Barberis | 60/39.826 |
| 2,889,480 | A | * | 6/1959 | Moignet et al. | 313/111 |
| 2,957,460 | A | * | 10/1960 | Kolbe | 123/54.7 |
| 2,972,225 | A | * | 2/1961 | Cumming et al. | 60/250 |

(Continued)

FOREIGN PATENT DOCUMENTS

| | | | | |
|---|---|---|---|---|
| FR | 2593905 | A1 | * | 8/1987 |
| FR | 2884594 | A1 | * | 10/2006 |
| JP | 2006132900 | A | * | 5/2006 |
| JP | 4917548 | B2 | * | 4/2012 |

*Primary Examiner* — Kang Hu
*Assistant Examiner* — Nathaniel Herzfeld
(74) *Attorney, Agent, or Firm* — Browdy and Neimark, PLLC

(57) ABSTRACT

The invention relates to a hot air internal ignition burner/generator comprising an injection device used for producing a high-speed fuel gas mixture stream and for injecting said stream into the burner head (2) which is tabular-shaped and comprises in-series arranged therein a pressure recovery chamber (10), an igniting chamber (11) and simple or multiple diffusion means (24) which are fixed inside the head (2), where two chambers are jointed, wherein said diffusion means (24) comprise a central orifice provided with an igniting tube which penetrates therein and axially extends inside the pressure recovery chamber (10) in such a way that it defines the ignition chamber (43) provided with igniting electrodes (42) connected to the pressure recovery chamber (10) of the burner (2) via a calibrated orifice (46).

18 Claims, 7 Drawing Sheets

(56) References Cited

U.S. PATENT DOCUMENTS

| | | | | | |
|---|---|---|---|---|---|
| 3,023,623 | A | * | 3/1962 | Lang et al. | 73/865.9 |
| 3,033,278 | A | * | 5/1962 | Scarr, Jr. | 239/438 |
| 3,037,388 | A | * | 6/1962 | Berggren | 73/717 |
| 3,229,676 | A | * | 1/1966 | Ulbing | 123/268 |
| 3,244,219 | A | * | 4/1966 | Nesbitt | 431/249 |
| 3,248,924 | A | * | 5/1966 | Boynton | 73/12.08 |
| 3,296,728 | A | * | 1/1967 | Kvavle | 42/106 |
| 3,302,523 | A | * | 2/1967 | Adams et al. | 89/7 |
| 3,326,084 | A | * | 6/1967 | Barbieri et al. | 89/7 |
| 3,330,108 | A | * | 7/1967 | Kvavle et al. | 60/634 |
| 3,357,504 | A | * | 12/1967 | Calhoun | 175/4.52 |
| 3,358,736 | A | * | 12/1967 | Reed et al. | 431/346 |
| 3,371,188 | A | * | 2/1968 | Henes et al. | 392/476 |
| 3,411,073 | A | * | 11/1968 | Marr | 324/463 |
| 3,417,740 | A | * | 12/1968 | Pericwitz | 123/182.1 |
| 3,440,870 | A | * | 4/1969 | Leto | 73/114.13 |
| 3,471,246 | A | * | 10/1969 | Norstedt et al. | 431/150 |
| 3,479,997 | A | * | 11/1969 | Hill et al. | 123/274 |
| 3,506,559 | A | * | 4/1970 | Bonga | 204/224 M |
| 3,523,748 | A | * | 8/1970 | Emmel et al. | 431/264 |
| 3,552,657 | A | * | 1/1971 | Chisholm et al. | 239/424 |
| 3,558,285 | A | * | 1/1971 | Ciccone et al. | 422/165 |
| 3,600,571 | A | * | 8/1971 | Chisholm et al. | 362/232 |
| 3,667,894 | A | * | 6/1972 | Flournoy | 431/114 |
| 3,677,131 | A | * | 7/1972 | Nee | 89/1.703 |
| 3,688,964 | A | * | 9/1972 | De Caro | 227/10 |
| 3,779,694 | A | * | 12/1973 | Zagoroff | 431/347 |
| 3,830,204 | A | * | 8/1974 | McAlister | 123/297 |
| 3,832,520 | A | * | 8/1974 | Glasser | 219/137.52 |
| 3,884,618 | A | * | 5/1975 | Neyret | 431/254 |
| 3,917,442 | A | * | 11/1975 | Zagoroff | 431/351 |
| RE28,665 | E | * | 12/1975 | Zagoroff | 431/347 |
| 3,980,061 | A | * | 9/1976 | McAlister | 123/297 |
| 4,061,120 | A | * | 12/1977 | Hughes | 123/143 A |
| 4,066,046 | A | * | 1/1978 | McAlister | 123/295 |
| 4,252,259 | A | * | 2/1981 | Brosius | 227/8 |
| 4,272,350 | A | * | 6/1981 | Croset et al. | 204/426 |
| 4,288,980 | A | * | 9/1981 | Ernst | 60/39.23 |
| 4,348,172 | A | * | 9/1982 | Miller | 431/255 |
| 4,405,072 | A | * | 9/1983 | Kindle et al. | 227/10 |
| 4,483,364 | A | * | 11/1984 | Ayler | 137/334 |
| 4,621,771 | A | * | 11/1986 | Chiba et al. | 239/585.4 |
| 4,628,177 | A | * | 12/1986 | Dempsey et al. | 219/121.49 |
| 4,631,023 | A | * | 12/1986 | Courrege | 431/329 |
| 4,776,694 | A | * | 10/1988 | Rogasch et al. | 356/315 |
| 4,805,587 | A | * | 2/1989 | Schweitzer | 126/39 L |
| 4,846,716 | A | * | 7/1989 | Courrege | 431/263 |
| 4,938,687 | A | * | 7/1990 | Monteil | 431/264 |
| 5,005,641 | A | * | 4/1991 | Mohaupt | 166/63 |
| 5,052,817 | A | * | 10/1991 | Bement et al. | 374/8 |
| 5,056,720 | A | * | 10/1991 | Crum et al. | 239/698 |
| 5,147,199 | A | * | 9/1992 | Perthuis et al. | 431/10 |
| 5,263,849 | A | * | 11/1993 | Irwin et al. | 431/6 |
| 5,271,564 | A | * | 12/1993 | Smith | 239/532 |
| 5,344,310 | A | * | 9/1994 | Harbeck et al. | 431/158 |
| 5,364,262 | A | * | 11/1994 | Phillips | 431/202 |
| 5,395,046 | A | * | 3/1995 | Knobbe et al. | 239/3 |
| 5,460,515 | A | * | 10/1995 | Harbeck et al. | 431/263 |
| 5,513,981 | A | * | 5/1996 | Harbeck et al. | 431/263 |
| 5,568,803 | A | * | 10/1996 | Brown | 126/21 A |
| 5,713,596 | A | * | 2/1998 | Messina et al. | 280/737 |
| 5,771,880 | A | * | 6/1998 | Tsai | 126/414 |
| 5,865,614 | A | * | 2/1999 | Hsu | 431/255 |
| 5,898,126 | A | * | 4/1999 | Yoshida | 149/46 |
| 5,921,231 | A | * | 7/1999 | Butler | 126/414 |
| 6,010,329 | A | * | 1/2000 | Zagoroff | 431/158 |
| 6,059,479 | A | * | 5/2000 | Clune | 403/24 |
| 6,070,989 | A | * | 6/2000 | Yokoyama et al. | 362/186 |
| 6,079,334 | A | * | 6/2000 | Roheim | 102/394 |
| 6,227,846 | B1 | * | 5/2001 | Zagoroff | 431/345 |
| 6,238,207 | B1 | * | 5/2001 | Sarkinen | 431/353 |
| 6,382,959 | B2 | * | 5/2002 | Turk et al. | 431/12 |
| 6,435,863 | B2 | * | 8/2002 | Damrath et al. | 431/354 |
| 6,648,630 | B2 | * | 11/2003 | Tse | 431/153 |
| 7,578,267 | B2 | * | 8/2009 | Hofbauer et al. | 123/51 BC |
| 7,641,231 | B2 | * | 1/2010 | Tieu | 280/736 |
| 2002/0117484 | A1 | * | 8/2002 | Jones et al. | 219/121.57 |
| 2002/0144636 | A1 | * | 10/2002 | Tsumura et al. | 110/347 |
| 2003/0122363 | A1 | * | 7/2003 | Muller | 280/806 |
| 2003/0227159 | A1 | * | 12/2003 | Muller | 280/731 |
| 2005/0100848 | A1 | * | 5/2005 | Meister et al. | 431/349 |
| 2005/0211217 | A1 | * | 9/2005 | Boley et al. | 123/266 |
| 2005/0255419 | A1 | * | 11/2005 | Belashchenko et al. | 431/278 |
| 2006/0242888 | A1 | * | 11/2006 | Bedoukian | 43/107 |
| 2007/0160945 | A1 | * | 7/2007 | Lin | 431/344 |
| 2008/0057454 | A1 | * | 3/2008 | Suzuki et al. | 431/153 |
| 2008/0213712 | A1 | * | 9/2008 | Huang | 431/153 |
| 2009/0020992 | A1 | * | 1/2009 | Jager et al. | 280/741 |
| 2010/0081105 | A1 | * | 4/2010 | Guillou et al. | 432/47 |
| 2010/0083863 | A1 | * | 4/2010 | Humbert et al. | 102/530 |
| 2010/0125267 | A1 | * | 5/2010 | Lee et al. | 606/27 |
| 2011/0033810 | A1 | * | 2/2011 | McDonough et al. | 431/344 |
| 2011/0034914 | A1 | * | 2/2011 | Auge et al. | 606/33 |
| 2011/0059408 | A1 | * | 3/2011 | Carroni et al. | 431/9 |
| 2011/0121735 | A1 | * | 5/2011 | Penny | 315/111.21 |
| 2011/0258981 | A1 | * | 10/2011 | Keidar et al. | 60/202 |

* cited by examiner

HOT AIR INTERNAL IGNITION BURNER/GENERATOR

BACKGROUND OF THE INVENTION

1. Field of the Invention

The present invention relates to a hot air burner/generator with internal ignition.

It is notably but not exclusively applied to gas burners with an intrinsically cold nozzle capable of carrying out an external combustion of a high velocity gas mixture.

2. Description of the Prior Art

It is known that burners of this type are frequently applied to low temperature heating of plastic film, for example polyethylene film in view of their retraction, by means of a gas flow from the combustion of a combustible gas such as propane and air.

In order to satisfy this type of application, the burner should therefore be designed so as to produce a gas flow having a temperature of the order of 120 to 540° C. at a predetermined distance from the burner (a distance at which the plastic film to be treated should be positioned).

At this distance, the temperature should be relatively homogenous and the gas flow free of combusting material, if the intention is to avoid any possibility of burning, singeing and blistering of the film.

In order to achieve this result, a burner has already been proposed, comprising an injection device capable of producing a flow of a combustible gas mixture at a high velocity and injecting this flow into a burner head with a tubular shape successively including:

a pressure recovery chamber having, in the plane of symmetry of the head, a divergent shape and inside of which the gas mixture from the injection device develops according to a fan-shaped configuration, an ignition chamber with a substantially constant and rectangular section, two baffles which respectively extend along both large sides of the ignition chamber, and which converge towards each other, each baffle having two rectilinear front borders forming together a passage with reduced width, and diffusion means which may comprise a grid or even a set of two grids, with a substantially hemicylindrical shape attached inside the head at the junction of both chambers, these diffusion means forming a bulging partition, with an axis parallel to said borders, in said plane of symmetry, and the concavity of which is oriented towards the inside of the pressure recovery chamber.

In this burner, the diffusion means may be made from wire netting or from a perforated metal sheet.

It is found that, by means of the structure described earlier, the burner head is not licked by the flame and therefore does not undergo any significant heating.

In order to homogenize the forefront of the flame and to avoid having inopportune orientations of the burner induce heterogeneities of the flame, the use of circular shapes for the front borders of the ignition chamber and the baffles as well as for the diffusion grid, was proposed (Patent Application FR 87 06930).

Moreover, it is known that in order to carry out ignition of the flame, the use of an ignition spark plug mounted in a tubular housing opening out into the ignition chamber by means of an orifice provided in a location of the wall of said chamber located at right angles to the side area of the grid, has already been proposed.

However, during use, it is reported that this solution has a serious drawback. Indeed, the tubular housing of the plug forms a cavity generating a turbulent state of gas flow emitted by the perforations of the grid. Consequently, self-sustained permanent combustion of the gas flow may be established at the level of this cavity, causing heating of the wall of the ignition chamber, which is contrary to the sought purpose.

In order to attempt to suppress this drawback, an ignition device was also proposed, involving an ignition cavity outside the ignition chamber and communicating with the ignition chamber by means of a through-orifice with a reduced section provided in the wall of the ignition chamber substantially at right angles to the front region of the grid, the section of this orifice being provided sufficiently small so that the perturbations of the gas mixture flow at this orifice cannot generate a self-sustained parasitic combustion hearth capable of heating the wall of the ignition chamber.

Nevertheless, this solution has a drawback resulting from the fact that during ignition, the generated spark causes sudden combustion of the gas mixture in the ignition chamber. The combusting gases are ejected and will then ignite the flow of gas mixture which flows out of the central perforations of the grid of the burner. This is a noisy solution which is unpleasant for the operator and persons who are present around it.

Moreover, it is found that a significant problem which has to be solved in the design of a direct ignition device is that of the voltage and of the energy of the electric pulses which should be applied to the ignition electrodes, in order to obtain efficient ignition of the gas mixture which flows at a high velocity inside the burner. Indeed, in order to achieve direct ignition, the gap between the electrodes should be relatively large. This voltage and this instantaneous energy should therefore be relatively high so that it is suitable to use a sufficiently powerful generator on the one hand, and an electric connection between the generator and the electrodes on the other hand, which is particularly well insulated so as to prevent line losses or perturbations.

OBJECT OF THE INVENTION

Therefore more particularly, the object of the invention is to suppress all these drawbacks.

SUMMARY OF THE INVENTION

For this purpose, a gas burner is proposed having a cold nozzle of the aforesaid type wherein simple or multiple diffusion means comprise a central orifice into which an ignition chimney opens out which extends axially inside the pressure recovery chamber, this ignition chimney delimiting an ignition chamber provided with ignition electrodes, the ignition chamber being connected with the pressure recovery chamber of the burner by a calibrated orifice.

Thus, because of the pressure difference existing between the calibrated orifice and the outlet orifice of the ignition chimney, a gas mixture flow is generated inside the ignition chimney with a velocity less than the gas flow inside the combustion chamber and at a relatively low pressure. By using a radially oriented calibrated orifice, it is possible to prevent the outer orifice from being in an overpressure area and the gas mixture present inside the ignition chamber from being subject to turbulences.

Consequently, during the ignition, the spark generated between the ignition electrodes causes ignition with no deflagration of the gas mixture inside the ignition chamber, and combustion that propagates axially right up to the combustion chamber of the burner, thereby causing ignition of the burner.

It is found that this solution has multiple advantages:

The ignition chimney is constantly swept and cooled by the gas mixture flowing in the pressure recovery chamber of the burner.

Because it is not directly subject to the action of the flame generated in the burner, this ignition chimney is not the centre of a significant temperature rise.

Because it is not directly in contact with the walls of the burner, it does not risk causing overheating of this wall.

Taking into account the fact that ideal ignition conditions (flow velocity/pressure/absence of turbulences) may be generated inside the ignition chamber, it is possible to position electrodes so as to obtain sparks by means of pulses of lower energy and lower voltage than those which are usually required. Accordingly, the dimensions of the generator used and the requirements as regards insulation of the conductors connecting the generator to the electrodes may be reduced.

Because it is confined inside the pressure recovery chamber, the ignition chimney is protected against outer aggressions; it may therefore be made with more lightweight and more precise components.

Advantageously, the tubular ignition chamber may be extended at one of its ends with a chimney having a minimum passage section so as to prevent any flashback but nevertheless allow propagation of the gas mixture being combusted which is used for ignition, and the other end of which may be closed by a bushing in an insulating material provided with a coaxial ignition electrode. This electrode cooperates with at least one ring-shaped portion of the body made in an electrically conductive material which forms a second ignition electrode surrounding the first.

Moreover, the burner described earlier may be designed so that it may be equipped with an extender consisting in a possibly telescopic tubular component which may be inserted between the tubing of the injection device and the head of the burner.

Now, the use of such an extender poses at least three problems, i.e.:

A first problem results from the fact that during extinction of the burner, a relatively significant volume of gas mixture remains inside the assembly formed by the head of the burner, the extender and the injection tubing. Now, upon stopping the burner, the flow velocity of the gas mixture, notably through the diffusion grid, decreases before becoming zero. Consequently, below a certain flow velocity, diffusion means with perforations which were determined so as to obtain a significant gas flow at a relatively high velocity in the ignition chamber, no longer retain the flame. This is the reason why the combustion propagates inside the aforesaid assembly by producing a slight explosion. This explosion which is not without any risk especially has the drawback of being noisy and consequently difficult to accept in a factory or on a building site.

A second problem results from the fact that the extender is made in an electrically conductive material and is connected to the ground of the electric (piezoelectric) generator. Consequently, the conductor which passes in the extender for connecting the output of the electric generator to the ignition electrode positioned in the ignition chamber, forms with said extender a capacitor, the capacitance of which depends on the length of the extender and on the positioning of the conductor inside said extender. This capacitor has the drawback of absorbing a significant fraction of the electric charge delivered by the electric generator upon ignition. The charge applied to the ignition electrode is therefore lowered.

A third problem results from the fact that the gases propelled at high velocity by the injection tubing do not mix homogeneously inside the extender. This heterogeneity is itself a function of the length of the extender. The use of baffles intended to generate perturbations in the gas flow in order to enhance this homogeneity nevertheless has the drawback of slowing down the flow, which is contrary to the sought effect in a high velocity burner.

Therefore the object of the invention is to solve these problems even more.

Thus, with the object of solving the first problem, inside the ignition chamber, an additional grid or sieve is positioned, the mesh of which is smaller than that of the diffusion grid but for which the total passage section (sum of the sections of all the meshes) is larger than those of the diffusion means so as to prevent a flashback inside the extender without however causing a well-known slowing down of the gas flow.

Advantageously, this additional grid may be permanently positioned inside the pressure recovery chamber, against or in close proximity to the diffusion means. In the case when a dual diffusion grid is used, this additional grid may be positioned between both diffusion grids.

With the purpose of solving the second and third problems mentioned earlier, the invention proposes to use a rigid electric conductor including a portion which extends obliquely between the two connection members respectively located at the ends of the extender. This electric conductor will be connected:

on the one hand, through one of its ends, to an electrically conductive washer used as a ring-shaped electric diffuser, mounted in an insulating tubular sleeve provided at the end of the extender into which the head of the burner engages, and on the other hand, to a coaxial electric connection finger, mounted on an electrically insulating support in the second end, the connector preferably forming a bend, so as to reach a region symmetrical to that of the connection to the conductive washer before returning towards the electric connection finger. Of course, the distance separating the wall of the extender from the ends of the oblique portion of the electric conductor, has to be larger than a distance, determined so as to prevent formation of parasitic electric arcs.

By means of these arrangements, the capacitance of the capacitor formed between the conductor and the extender remains within acceptable limits, considering the performances of the ignition device described earlier. Moreover, the oblique portion of the conductor causes a gradual perturbation of the gas flow throughout the length of the extender, and on the whole of its section. This perturbation, with which a homogenous gas mixture may be obtained, does not however generate notable slowing down of the gas flow and this because of its progression along the oblique portion of the conductor.

In the case when the extender is telescopic, the electric conductor may be made in at least two rigid components, one of these components being tubular whereas the other one consists in a cylindrical rod which closely engages into the tubular component. Both of these components have at least partly the same oblicity.

The advantage of the arrangement already described then consists in that, because of the geometry of the conductor, the engagement and sliding of both components is slightly carried out with force, with friction between both components. Consequently, a contact area with contact pressure always exists between both components. An excellent electric connection is thereby obtained which eliminates the risks of forming electric arcs, unlike the solution which would consist of using two telescopic conductive components with an axis parallel to the sliding axis of the two sliding portions of the extender.

BRIEF DESCRIPTION OF THE DRAWINGS

Embodiments of the invention will be described hereafter, as non-limiting examples, with reference to the appended drawings wherein.

DESCRIPTION OF THE PREFERRED EMBODIMENTS

Figure 1:
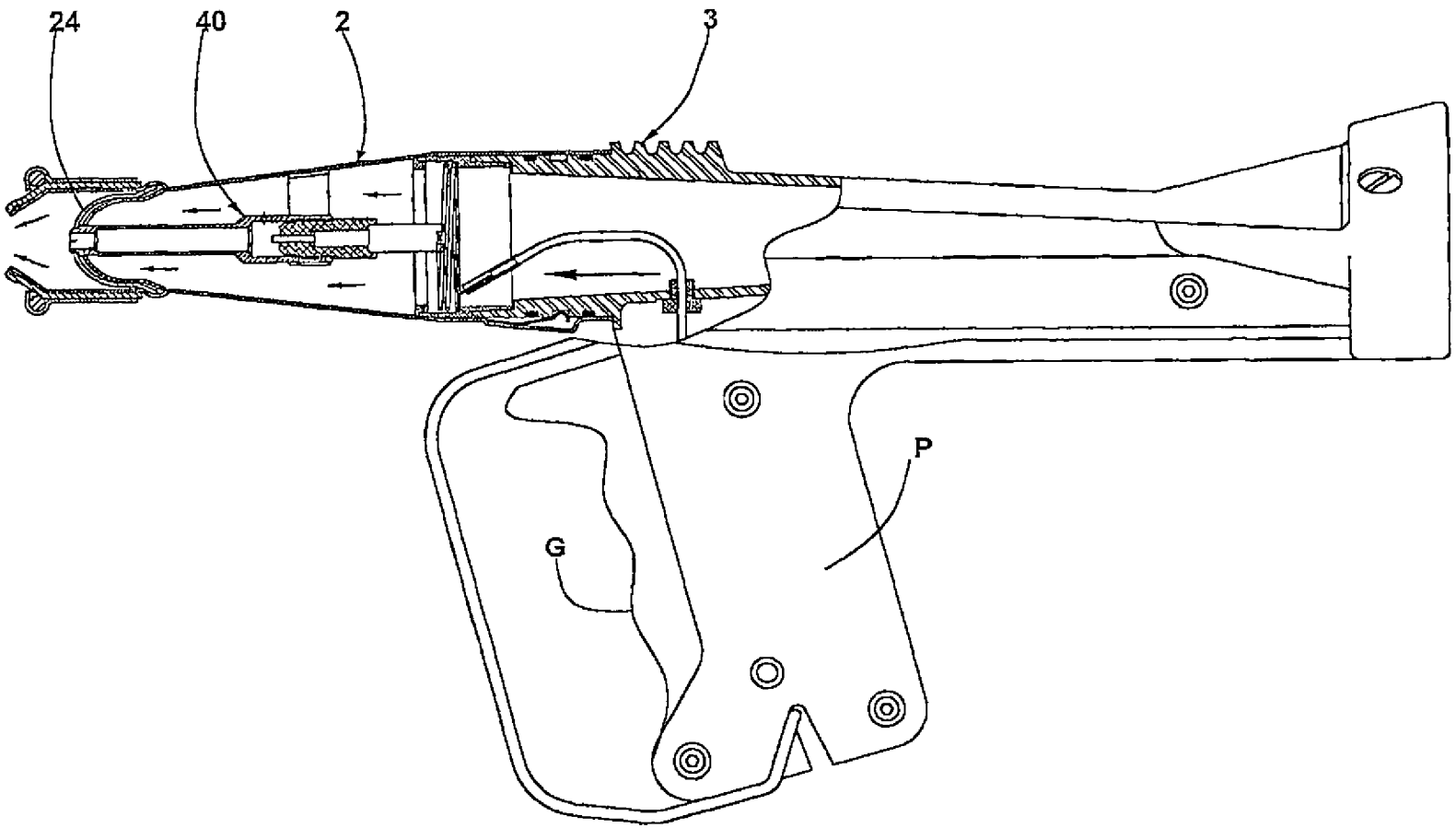
FIG. 1 is a sectional view in a vertical plane of a short high velocity burner of the cold nozzle type.
Figure 2:
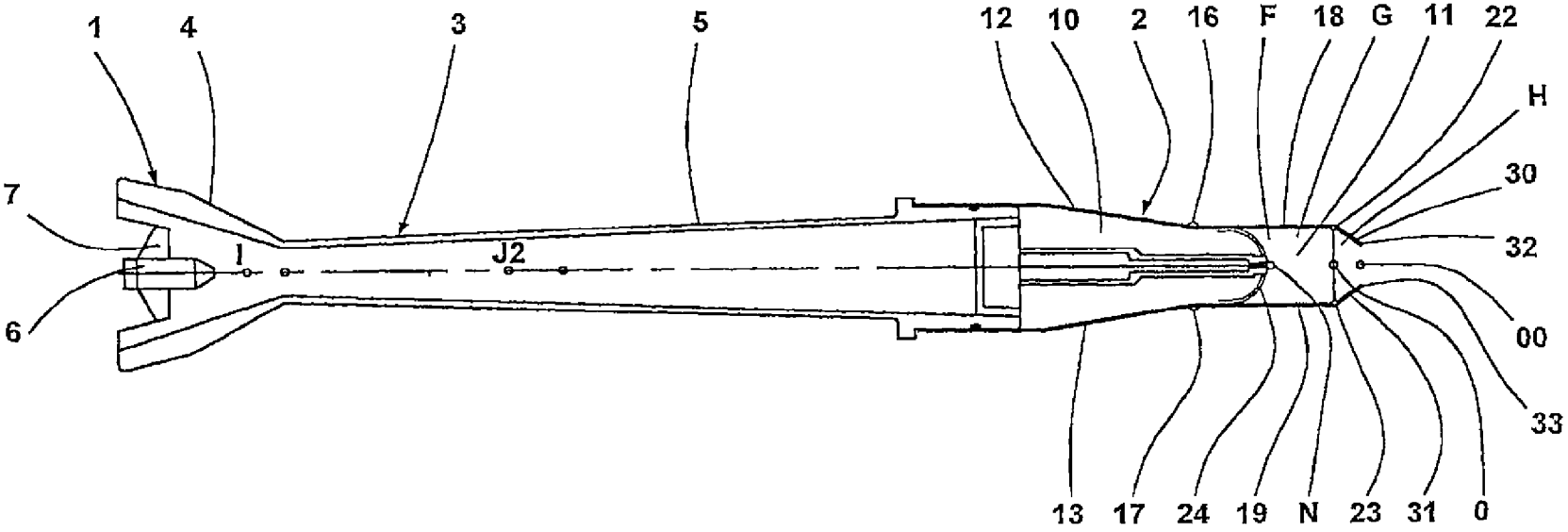
FIG. 2 is a schematic sectional view illustrating the operating principle of the burner illustrated in FIG. 1.
Figure 3:
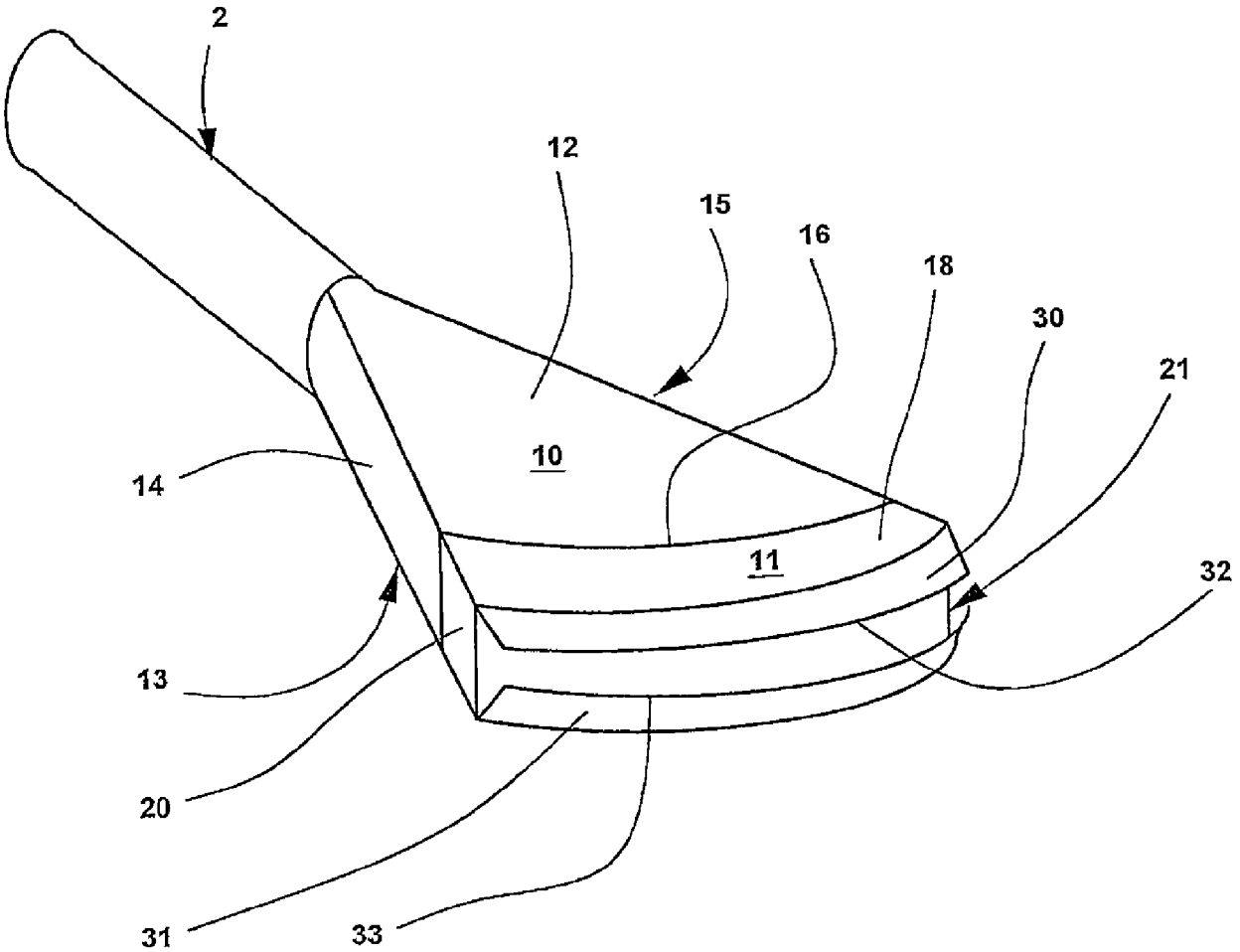
FIG. 3 is a schematic perspective view of the head of the burner.

In the example illustrated in FIGS. 1 to 3, the burner according to the invention comprises an injection device 1 capable of transmitting a flow of combustible gas mixture to the head of the burner 2.

This injection device 1 more particularly includes:

- a tubing 3 formed in two sections, i.e. a convergent rear section 4 and a substantially divergent front section 5,
- an injection nozzle 6 mounted in the convergent section 4, this nozzle 6 being connected to a source of flammable gas having a pressure of the order of 1 to 4 bars, and
- at least one aperture 7 for letting through air located in the ring-shaped area comprised between said nozzle 6 and said section 4.

This device therefore forms a jet pump which carries away the air from the opening 7 and generates in the convergent portion 4 of the tubing 3 (point I) a gas mixture flow at high velocity, of the order of 12,660 meters/minute.

The head of the burner 2 has a tubular shape, and consists of two electrically conductive metal portions which successively delimit a pressure recovery chamber 10 which is connected to the tubing and an ignition (or combustion) chamber 11 which opens out in free air.

The pressure recovery chamber 10 beyond its area for connection to the tubing 3, has a flared shape delimited by two convergent walls 12, 13 with increasing width and two divergent side walls 14, 15 with decreasing width. As is visible in FIGS. 2 and 3, the front borders 16, 17 of both convergent walls 12, 13 have coaxial circular shapes.

The combustion chamber 11 also has a flared shape. However, in this example, it is delimited by two parallel walls 18, 19 which extend both convergent walls 12, 13, and two divergent side walls 20, 21 which extend the side walls 14, 15, along the same orientations, respectively. The front borders 22, 23 of both walls 18, 19 are circular and extend coaxially with the borders 16, 17.

Both of these chambers 10, 11 are separated from each other by a dual diffusion grid 24 which consists in two perforated metal sheet parts having the shape of a toric sector with a substantially hemicylindrical section, and a large radius of curvature, which substantially corresponds to that of the front borders 16, 17 of the convergent walls 12, 13. The perforated metal sheet on the pressure recovery chamber 10 side has at its centre a long and narrow oblong cutout.

The attachment of this diffusion grid 24 inside the head of the burner 2 is carried out in the junction area of the chambers 10 and 11, the concavity of this grid being directed towards the pressure recovery chamber 10.

The walls 18 and 19 of the combustion chamber 11 are extended by two baffles 30, 31 of semi-circular shape which substantially converge towards each other and have two respective coaxial borders 32, 33 which form between them a passage space with a width less than the width of the lateral sides 20, 21 of the combustion chamber 11.

The operating principle of this burner head is then the following:

Inside the pressure recovery chamber 10, the velocity of the gas mixture undergoes a slight reduction while it develops into a fan-shaped configuration. At the diffusion grid 24, a relatively homogeneous pressure area is then formed due to conversion of kinetic energy of the gas flows.

Through the perforations of the grid 24, the combustible mixture forms a succession of jets which are again accelerated (point N at 2,400 m/min, FIG. 2).

In the median portion of the grid 24, these jets are oriented axially whereas in the side portions they are substantially radial and will abut on the walls 18, 19 and on the baffles 30, 31.

In the middle portion of the grid 24, the gas flow formed by the jets undergoes deceleration $\Delta V_1$ (point O at 1,600 m/min). This results from the fact that at the exit of the perforations of the middle area of the grid 24, expansion of the combustible mixture occurs, this expansion being promoted by the jet distribution of the gas flow. With this reduction in flow velocity, combustion may be established at a slight distance from the grid 24.

Beyond the point O, combustion of the gas mixture is established and a slight acceleration of the gases (expansion due to the combustion) is seen. However, the velocity at point OO (FIG. 2) remains less than the one measured at point N.

At the exit of the diffusion grid 24, the velocity of the gas flow is not homogeneous which should in principle lead to heterogeneity of the flame.

This drawback is suppressed by using baffles 30, 31, which deviate the flow areas of the combustible mixture from the side portions of the grid 24 and cause them to slightly converge towards the central region of the gas flow.

At the same time, the velocity of the gas flow is reduced by a driving effect, substantially back to that of the central portion of the flow. The combustion of the gas mixture then forms a fan-shaped flame beyond the front borders of the baffles 30, 31.

Figure 4:
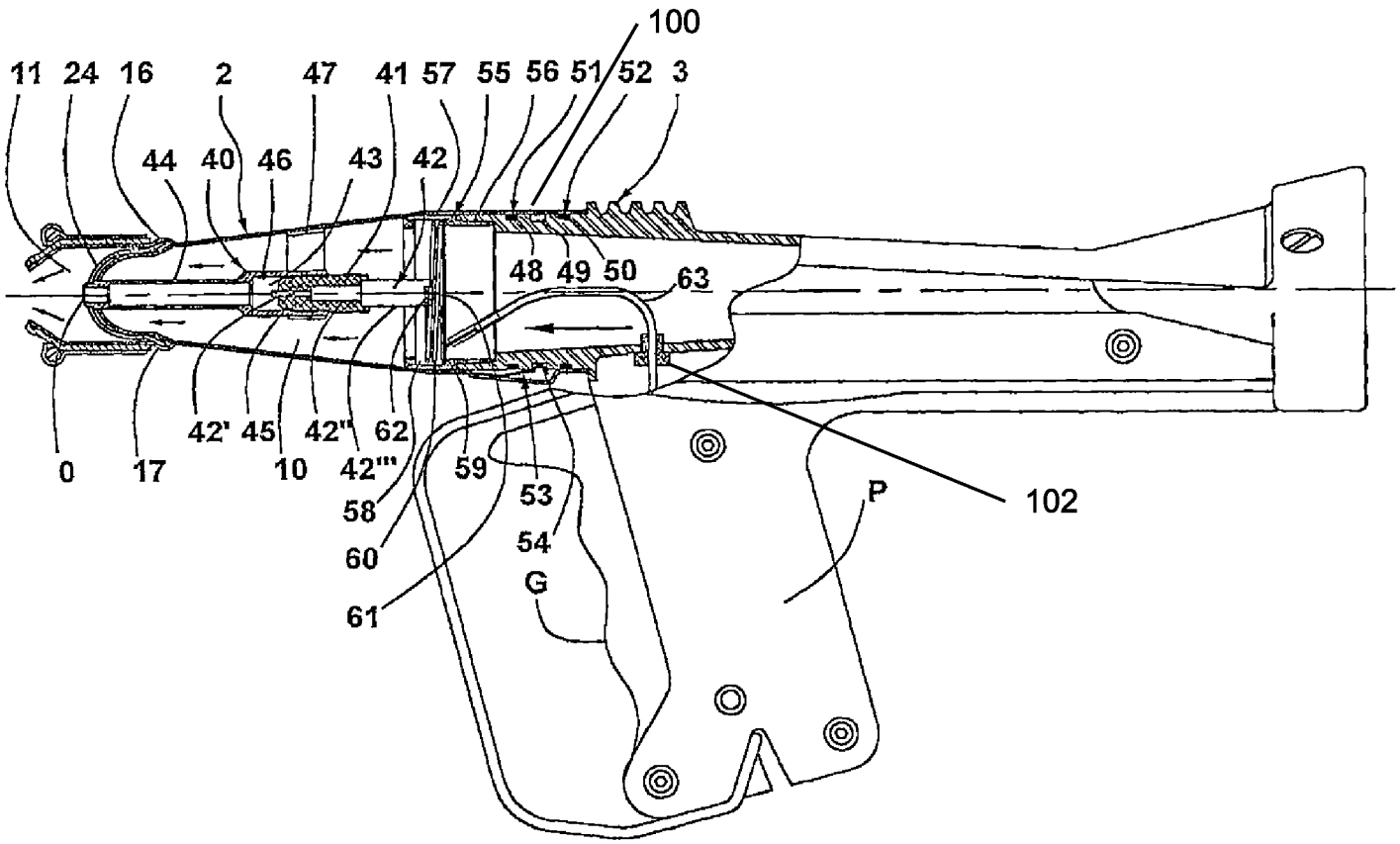
FIG. 4 is a sectional view at a larger scale of the head of the burner illustrated in FIG. 1.
Figure 5:
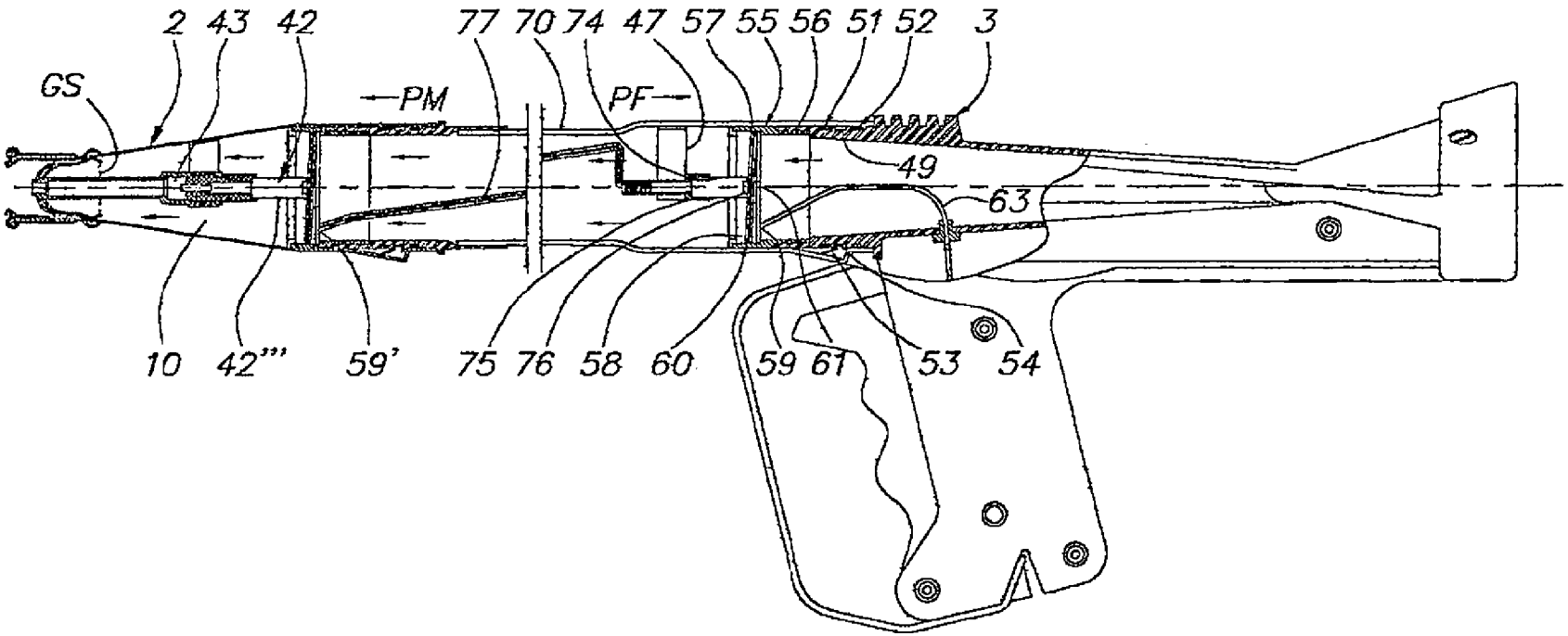
FIG. 5 is a partial sectional view of an alternative embodiment of the burner of FIG. 1 equipped with an extender.

According to the invention as illustrated in FIGS. 4 and 5, this ignition device involves a cylindrical ignition chamber 43 which extends coaxially at the head 2 of the burner inside the pressure recovery chamber 10 via an ignition chimney (first tubular portion) 44 which crosses the dual perforated grid 24 in its centre and opens out into the combustion chamber 11 while an insulating tubular bushing 41 with a staged bore in which is positioned a cylindrical ignition electrode 42 having three successive stages 42', 42", 42'" corresponding to the staging of said bore, engages into the other end of the ignition chamber.

The staging 42' of the electrode 42 which has the smallest diameter juts out outside the bushing 41, inside an ignition chamber 43.

The staging 42'" of larger diameter extends outside the bushing 41 right up to the connection between the tubing 3 and the head 2 of the burner.

In fact, the electrically conductive ignition assembly 40 includes: a first tubular portion (ignition chimney) 44 with a small passage section, and a second tubular portion 45 of larger inner section. A first end of the ignition chimney 44 is engaged through the dual grid 24, and a second end of the ignition chimney is connected to a first end of the second tubular portion 45. The second tubular portion 45 is closed on a second end that is opposite to the first end by the insulating bushing 41 of the electrode 42.

This second tubular portion 45 delimited by the first tubular portion (ignition chimney) 44 and the bushing 41 in an insulating material, equipped with the electrode 42, represents the ignition chamber 43 into which a calibrated orifice 46 opens out, provided in the tubular component 45, this calibrated orifice 46 extending radially.

The ignition assembly 40 is in electric contact with two electrically conductive portions of the head 2 of the burner, via the dual grid 24 on one end, and through an electrically conductive supporting part 47 on the other end, which extends radially into the pressure recovery chamber 10.

The head 2 of the burner fits onto the end of the tubing 3 by means of an assembly with which both a seal and good electric connection may be provided, it being understood that the tubing 3 is electrically connected to the ground of a piezoelectric generator housed in a handle P firmly attached to said tubing 3. Actuation of the piezoelectric generator is provided by means of a trigger G with which the handle P is equipped.

This assembly involves three successive coaxial grooves 48, 49, 50 shifted axially, provided in the fitting area 100 of the tubing 3, two O-ring gaskets 51, 52 of a resilient material, respectively positioned in the first 48 and third grooves 50, and a elastically deformable metal retention blade 53, the curved end 54 of which is intended to be engaged into the central groove 49. The metal blade is firmly attached to the head of the burner.

With this arrangement, it is possible to achieve sealed fast assembling in spite of the manufacturing tolerances of the head 2 and of the tubing 3, good electric contact by means of the tab 53 and of the contact areas between the head 2 and the tubing 3 and a seal by means of the O-ring gasket 52 (the O-ring gasket 51 essentially providing a guide and retention role).

The piezoelectric generator is moreover connected to the ignition electrode 42 by means of an electric conductive wire 63 and a connector 102 located at the fitting area of the tubing 3.

In this example, this connector involves an insulating collector support 55 appearing as a staged tubular sleeve, of an insulating material, comprising a first staging 56 which fits into the tubing 3 and a second staging 57 with a larger outer diameter which has an inner surface forming a ring-shaped groove 58.

An electrically conductive washer 59 and a helical metal spring 60 are positioned in the ring-shaped groove. The electrically conductive washer 69 is connected to the electric conductive wire 63 and being used as a ring-shaped electric diffuser. The helical metal spring 60, the end of which located towards the outside of the tubing, is extended by a radial rectilinear strand 61 which extends diametrically.

The length of the jutting-out portion of the electrode 42 is determined so that in the assembled position of the head 2 on the tubing 3, the rectilinear strand 61 of the spring 60 engages into a radial groove 62 made in the end of the electrode 42 and remains applied in the bottom of this groove 62 so as to be able to drive the spring 60 into rotation on the electrically conductive washer 59 upon rotating the burner head 2, the whole thereby forming a rotating collector. (Advantageously, the end of the electrode may comprise two radial grooves at 90° from each other).

By these arrangements, and in particular by the compression of the spring between the rectilinear strand 61 and the washer 59, excellent electric contact is obtained between the rectilinear strand 61 and the electrode 42 on the one hand, between the metal washer 59 and the last ground single coil close to the spring 60 on the other hand.

Figure 6:
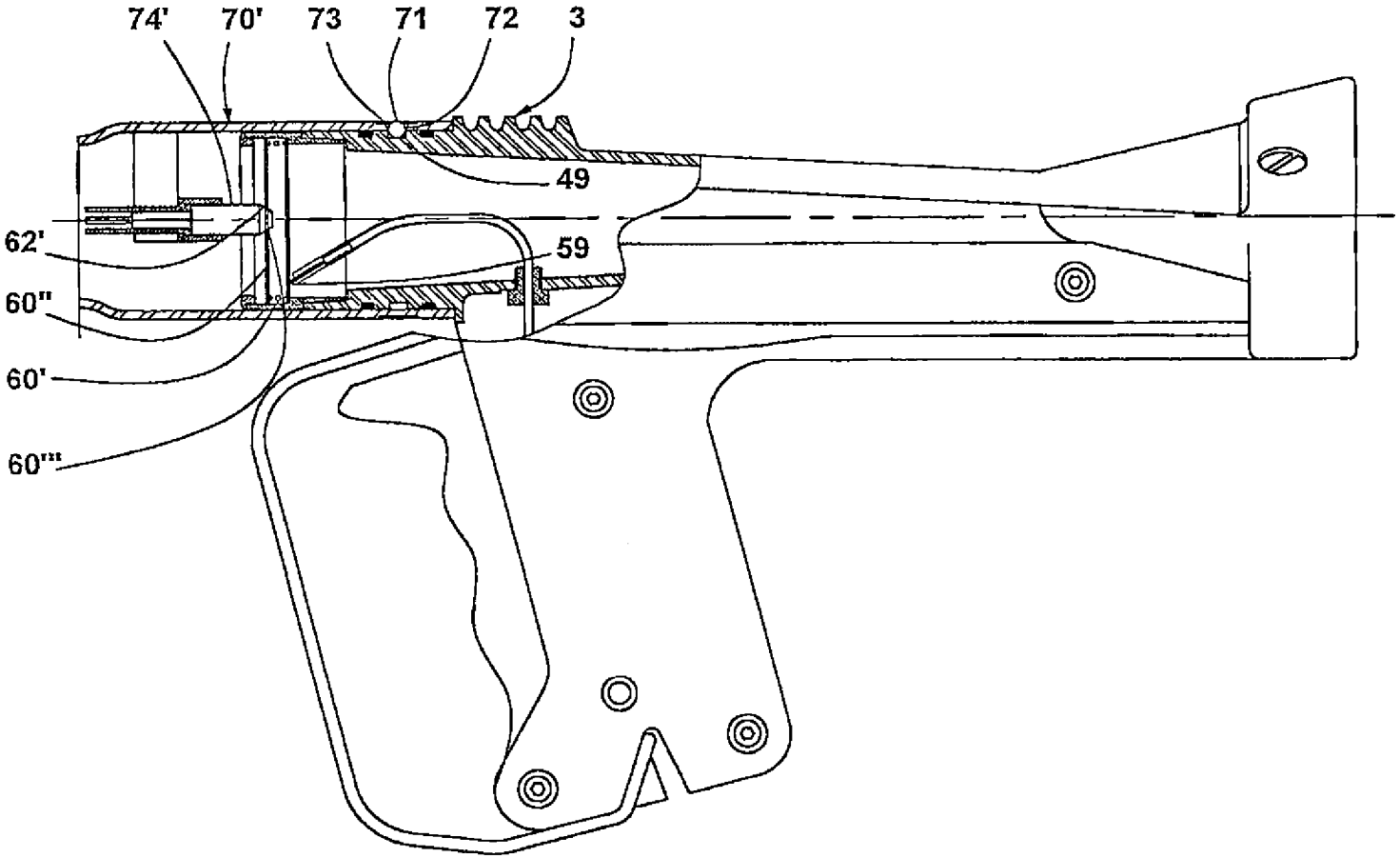
FIG. 6 is a partial sectional view of alternative techniques relating to the snap-on system of the extender and the connection of the ignition electrode.

An alternative of the design of FIGS. 4 and 5, shown in FIG. 6, consists of replacing the aforesaid spring 60 with the spring 60' and the washer 60" including an axial actuating device 60''' connected to its peripheral portion through one or several connecting arms. This actuating device 60''' engages into or around the opposite face 62' of the electrode 74' so as to be able to drive the washer 60" into rotation on the spring 60' supported on the electrically conductive washer 59 during rotation of the burner head 2, the whole thereby forming a rotating collector.

As mentioned earlier, an advantage of the solution described earlier consists in that the gas mixture which flows into the tubing 3 sees its pressure increased in the pressure recovery chamber 10 due to the presence of the dual grid 24, whereas it is lowered at the exit of this dual grid 24, in the combustion chamber 11.

Because of this pressure difference and of the presence of the calibrated orifice 46, a gas mixture flow occurs inside the ignition chimney 40.

When the piezoelectric generator is actuated via the trigger G, the produced electric pulse is applied to the electrode 42 and to the ignition assembly 40, which plays the role of a second electrode.

With this arrangement, it is further possible to perform a rotation of the burner head 2 relatively to the tubing 3 without causing malfunction of the burner or of its ignition system.

Therefore, between both of these electrodes, a spark occurs which causes combustion of the gas mixture present in the ignition chamber 43. This combusting gas mixture moves along the chimney 44 until it reaches its outlet orifice O. As soon as the combusting gas mixture volume present in the combustion chamber 11 is sufficient, the gas mixture delivered by the orifices of the dual grid 24 catches fire and accordingly produces a slight pressure increase causing extinction of the gas mixture inside the chimney.

As mentioned earlier, the hot air generator/burner may comprise a tubular extender 70 which will be inserted between the front end of the tubing 3 and the head 2 of the burner. In this case in order to prevent flashbacks upon stopping the burner, a sieve GS (shown in FIG. 5) is positioned behind or instead of the grid having an oblong cutout in the pressure recovery chamber, or between both grids. This sieve GS comprises a central orifice through which passes the chimney 44.

In the example illustrated in FIG. 5, the extender 70 consists in a rigid tube, possibly a bent tube, having on one side a female assembly profile PF of a type similar to the one used in the head of the burner.

However, in this case, instead of the snap-on flexible blade 53, this female assembly profile may comprise according to FIG. 6, a snap-on mechanism comprising a ball 71 retained inside a conical opening 72 by an elastic ring 73, so that it may be partly engaged into the central groove 49 of the end of the tubing 3.

Moreover, in FIG. 5, the extender 70 is provided at this female assembly profile, with a coaxial electric contact finger 74 mounted on a support in an electrically insulating material 75 attached by means of the support 47 to the inside of the extender 70 at the base of the assembly profile PF.

This electric contact finger 74 in the same way as that of the electrode 42, comprises two radial cross grooves 76 intended to receive the radial rectilinear strand 61 of the spring 60.

The front end of the extender intended to receive the head 2 of the burner has a male assembly profile PM identical with the one provided at the end of the tubing 3 and which will therefore not be described again.

The electric diffusion washer 59' with which this male assembly profile PM is equipped, is then connected to the electric contact finger 74 via an electrically conductive connecting rod 77. This connecting rod beyond its connection to the washer 59' has a rectilinear section which extends obliquely with respect to the longitudinal axis of the extender. Both of the ends of this section are symmetrical with respect to a median point located on said longitudinal axis. The end is connected to the electric contact finger by a portion comprising a substantially radial segment and two bent ends. The advantages of this arrangement have been described earlier and will therefore not be stated again.

Optionally, the extender may be bent and/or telescopically extensible.

In the latter case, it may be made in at least two tubular sections sliding in each other equipped with means with which temporary axial blocking may be provided, limiting the rotational movements relatively to each other.

In this case, the conductive connecting rod 77 may be made as a coil by means of shape memory materials, the diameter of the individual coils being less than the inner diameter of the extender. With this solution, an extensible electric connection may be obtained which only perturbs to a very slight extent the flow of gas mixture circulating in the extender.

Figure 7:
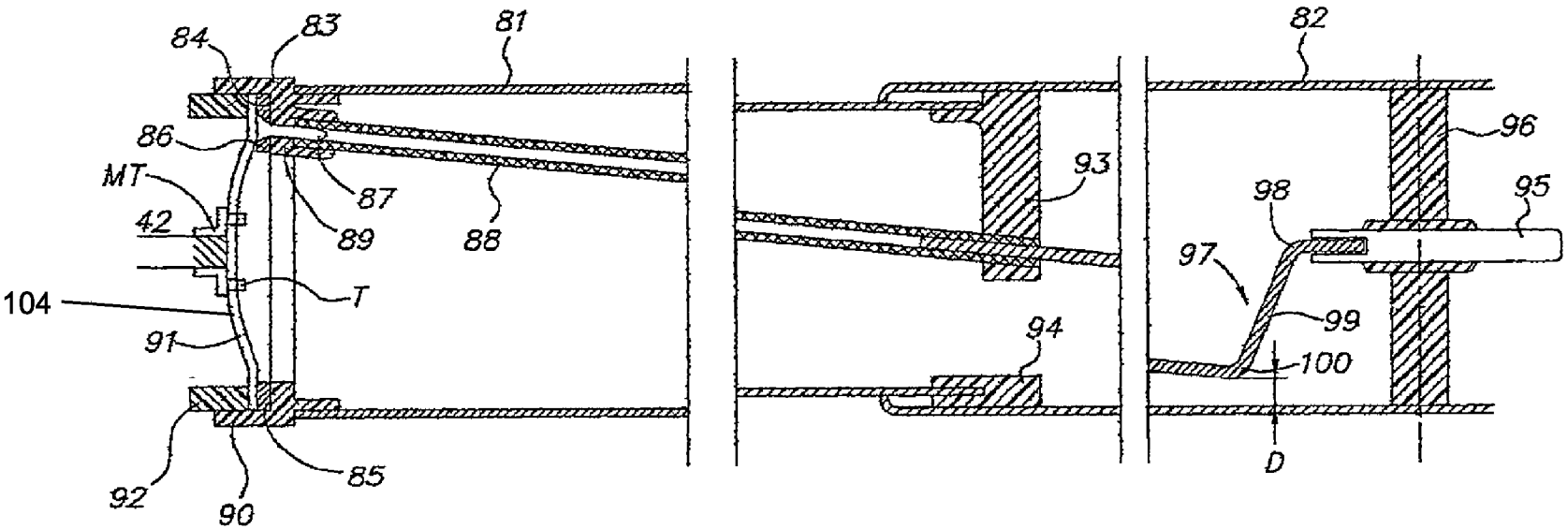
FIG. 7 is a schematic partial sectional view of a telescopic extender.

In the example illustrated in FIG. 7, the extender consists of two cylindrical tubular components 81, 82 with slightly different diameters which fit into each other telescopically.

The end of the tubular component 81 opposite to the fitting area comprises a connecting device similar to the one which was described with reference to FIG. 5 and which comprises a tubular sleeve 83 in an electrically insulating material, which partly fits into the component 81. This tubular sleeve 83 has a bore step 84 against which an electrically conductive washer 85 is positioned, provided with a connecting tab 86 protruding inwards. This connecting tab has a opening through which a fixing screw passes which will be screwed into an electric bushing 87 into which an electrically conductive connecting tube 88 engages. This bushing 87 is positioned inside a sheath 89 in an electrically insulating material firmly attached to the sleeve 83 through a spacer.

A rotary connecting member comprising a ring-shaped component 90 in contact with the washer 85 and a rectilinear component 91 provided with a central embossment 104, which connects two diametrically opposite points of the ring-shaped component 90, is maintained applied against the washer 85.

Maintaining this ring-shaped component 90 in contact with the washer 85 is provided by means of a ring 92 in an electrically insulating material, which fits into the tubular sleeve 83.

In the same way as the rectilinear strand 61 according to FIG. 5, the rectilinear component 91 is intended to be supported on the front face of the electrode 42 of the head of the burner. Nevertheless, in this case, instead of engaging into the radial groove 62 according to FIG. 4, it engages into the spaces comprised between axially protruding nipples, provided on the front face of a tubular sleeve MT into which the end of the electrode 42 engages. Advantageously, the sleeve MT may comprise five nipples T uniformly distributed over its circumference.

Inside the tubular component 81, the rectilinear connecting tube 88 extends obliquely with respect to the longitudinal axis of the extender.

This tube 88 extends right up to the other end of the component 81. At this end, it is held in position, in the central region of the tubular component 81 by a radial support 93 made in an electrically insulating material firmly attached to an insulating sleeve 94 partly engaged into the component 81.

The end of the tubular component 82 located opposite to the fitting area contains a contact finger 95 similar to the finger 76 described earlier, mounted on a support 96 in an electrically insulating material, and provided with two radial cross grooves intended to receive the radial rectilinear strand 61 of the spring 60 with which the end of the tubing 3 is equipped. Opposite to the radial grooves, the contact finger 95 comprises a cylindrical cavity into which an electrically conducting rod 97 engages. This rod 97 comprises at the outlet of the cavity, a first bend 98 and then a substantially radial portion 99 which extends until it reaches a region located at a determined distance D from the wall of the tubular component 82.

The rod 97 then has a second bend 100 which extends obliquely with respect to the longitudinal axis of the extender, so as to be introduced into the electric connecting tube 88 (the oblicity of the tube 88 being substantially equal to the oblicity of the rod 97, where the oblicity means the oblique angle of the tube 88 and the rod 97 with respect to the longitudinal axis of the extender).

Thus, when a relative displacement of both tubular components 81, 82 is caused, sliding of the rod 97 inside the tube 88 is caused. At the same time, elastic flexure of the rod 97 is caused in its portion located outside the tube 88. Consequently, an electric contact is permanently achieved with a contact pressure between the rod 97 and tube 88 regardless of the relative position of the tubular components 81, 82. Also, any play capable of being the centre of electric arcs during the ignition process is eliminated. As mentioned earlier, this solution further provides the advantage of causing progressive homogenization of the gas flow without causing any notable slowing down of this flow.

Another advantage of this solution consists in that the tubular components 81 and 82 may be subject to relative rotations without generating any perturbations at the electric connection level.

The invention claimed is:

1. A hot air burner/generator with internal ignition comprising:

a tubular burner head having a proximal end and a distal end;

an injection device connected to the proximal end of the burner head and capable of producing a high velocity flow of a combustible gas mixture and injecting the high velocity flow through the burner head;

the burner head including a pressure recovery chamber, the pressure recovery chamber having a flared shape delimited by two convergent walls having an increasing width and two divergent side walls having a decreasing width, the burner head further including a first ignition chamber, the first ignition chamber having a flared shape delimited by two parallel walls extending from the two convergent walls of the pressure recovery chamber and two divergent side walls of the first ignition chamber extending from the two divergent side walls of the pressure recovery chamber along the same orientations, respectively; and at least one diffusion grid attached between said pressure recovery chamber and said ignition chamber, said at least one diffusion grid having a central orifice and a concave shape with a concavity that is directed toward the first ignition chamber, an ignition chimney which extends axially inside the pressure recovery chamber, the ignition chimney having a proximal end and a distal end, the distal end of the ignition chimney extending through the central orifice of the at least one diffusion grid, a second ignition chamber and an ignition assembly, the second ignition chamber being situated between the ignition assembly and the proximal end of the ignition chimney, the ignition assembly including at least one first electrode for providing ignition to the gas flow.

2. The burner according to claim 1, wherein the second ignition chamber is tubular and is delimited on one side by the ignition chimney with a small passage section and closed on the opposite side by a bushing of an insulating material provided with the at least one first ignition electrode.

3. The burner according to claim 2, wherein said at least one first electrode cooperates with at least one ring-shaped portion made of an electrically conductive material, the ring-shaped portion forming a second ignition electrode surrounding the first.

4. The burner according to claim 1, wherein the ignition chimney is made of electrically conductive metal material.

5. The burner according to claim 3, wherein the aforesaid electrodes are electrically connected to an electric pulse generator housed in a handle attached to the burner.

6. The burner according to claim 1, wherein the head of the burner comprises an additional grid or sieve, having a mesh that is smaller than that of the diffusion grid and a total passage section that is larger than a total passage section of said diffusion grid.

7. The burner according to claim 6, wherein said additional grid or sieve is permanently positioned inside the pressure recovery chamber.

8. The burner according to claim 5, wherein the said burner head fits onto the end of a tubing of the injection device by an assembly including sealing gaskets and an electric connection tab allowing said burner to rotate with respect to said tubing.

9. The burner according to claim 8, wherein said assembly comprises three successive coaxial grooves, axially shifted, provided in a fitting area of said tubing, said sealing gaskets comprise two O-ring gaskets of a resilient material, respectively positioned in the first and third grooves and said electric connection tab comprises an elastically deformable metal retention blade, the blade having a curved end which is engaged with the central groove, this metal retention blade being firmly attached to said burner head.

10. The burner according to claim 8, wherein said electric pulse generator is connected to said first ignition electrode by means of an electric conductive wire and a connector located at the fitting area of the tubing.

11. The burner according to claim 10, wherein said connector comprises an insulating collector support in the form of a tubular sleeve which fits into or onto the tubing.

12. The burner according to claim 8, further comprising a tubular extender which is inserted between the front end of the tubing and the burner head.

13. The burner according to claim 12, comprising an electric connection passing inside the extender, said electric connection comprising a connecting rod having a rectilinear section which extends obliquely with respect to a longitudinal axis of the extender.

14. The burner according to claim 12, wherein the tubing comprises a male assembly profile at an end of the tubing, the extender comprises a rigid tube, having on a first side, a female assembly profile that connects to the male assembly profile of the end of the tubing and, on a second side, a male assembly profile identical with the male assembly profile of the tubing, the extender comprises, at the base of the female assembly profile, a coaxial electric contact finger mounted on a electrically insulating support, said electric contact finger comprising at least one radial groove intended to receive a radial rectilinear strand of a spring of the male assembly profile of the tubing, and the male assembly profile of the tubing comprising an electric diffusion washer connected to the electric contact finger via a flexible connecting conductive wire sheathed in an insulating coating.

15. The burner according to claim 14, wherein the female assembly profile has a ball snap-on mechanism.

16. The burner according to claim 12, wherein the extender is telescopically extensible and said burner has an electric connection comprising a connecting conductive rod made as a coil formed of shape memory materials.

17. The burner according to claim 12, wherein the extender is telescopically extensible and said burner has an electric connection made in at least two oblique rigid components relatively to a longitudinal axis of the extender, a first one of said two components having a tubular shape and a second one of said two components being a cylindrical rod which closely engages into the first one of said two components.

18. The burner according to claim 17, wherein said two components extend at an oblique angle with respect to the longitudinal axis of the extender.

* * * * *